US012559283B2

(12) United States Patent
Siegl

(10) Patent No.: US 12,559,283 B2
(45) Date of Patent: Feb. 24, 2026

(54) REFILLABLE PLASTIC CONTAINER

(71) Applicant: ALPLA Werke Alwin Lehner GmbH & Co. KG, Hard (AT)

(72) Inventor: Robert Siegl, Dornbirn (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 0 days.

(21) Appl. No.: 17/765,480

(22) PCT Filed: Sep. 23, 2020

(86) PCT No.: PCT/EP2020/076600
§ 371 (c)(1),
(2) Date: Mar. 31, 2022

(87) PCT Pub. No.: WO2021/063771
PCT Pub. Date: Apr. 8, 2021

(65) Prior Publication Data

US 2022/0371764 A1 Nov. 24, 2022

(30) Foreign Application Priority Data

Oct. 2, 2019 (CH) ..... 01248/19

(51) Int. Cl.
*B65D 1/02* (2006.01)
*B65D 41/34* (2006.01)

(52) U.S. Cl.
CPC ..... *B65D 1/0246* (2013.01); *B65D 1/0207* (2013.01); *B65D 41/3428* (2013.01)

(58) Field of Classification Search
CPC ..... B65D 1/0246; B65D 1/0207; B65D 41/3428; B65D 41/325
See application file for complete search history.

(56) References Cited

U.S. PATENT DOCUMENTS 3,944,104 A * 3/1976 Watson ..... B65D 41/0421 215/354
4,415,095 A * 11/1983 Schweigert ..... B65D 41/0428 215/DIG. 1
5,888,598 A 3/1999 Brewster et al.
5,954,215 A * 9/1999 Alter ..... B65D 41/185 215/354
6,063,325 A * 5/2000 Nahill ..... B29C 45/1646 264/328.8

(Continued)

FOREIGN PATENT DOCUMENTS

EP 1 092 639 A1 4/2001

OTHER PUBLICATIONS

International Society of Beverage Technologists: "PCO-1881 28mm Standard", Feb. 14, 2007, See International Search.

(Continued)

*Primary Examiner* — Andrew T Kirsch
(74) *Attorney, Agent, or Firm* — Finch & Maloney PLLC

(57) ABSTRACT

The invention relates to a refillable plastic container (100) which comprises a neck (10) having a neck opening (11) and a container body enclosing a filling volume which are separated from one another by a substantially radially protruding support ring (30). The neck of the plastic container has an axial length (L) equal to or less than 17.25 mm, measured from a mouth rim (12) of the neck opening to an underside of the support ring.

27 Claims, 3 Drawing Sheets

(56) References Cited

U.S. PATENT DOCUMENTS

Figure 1A:
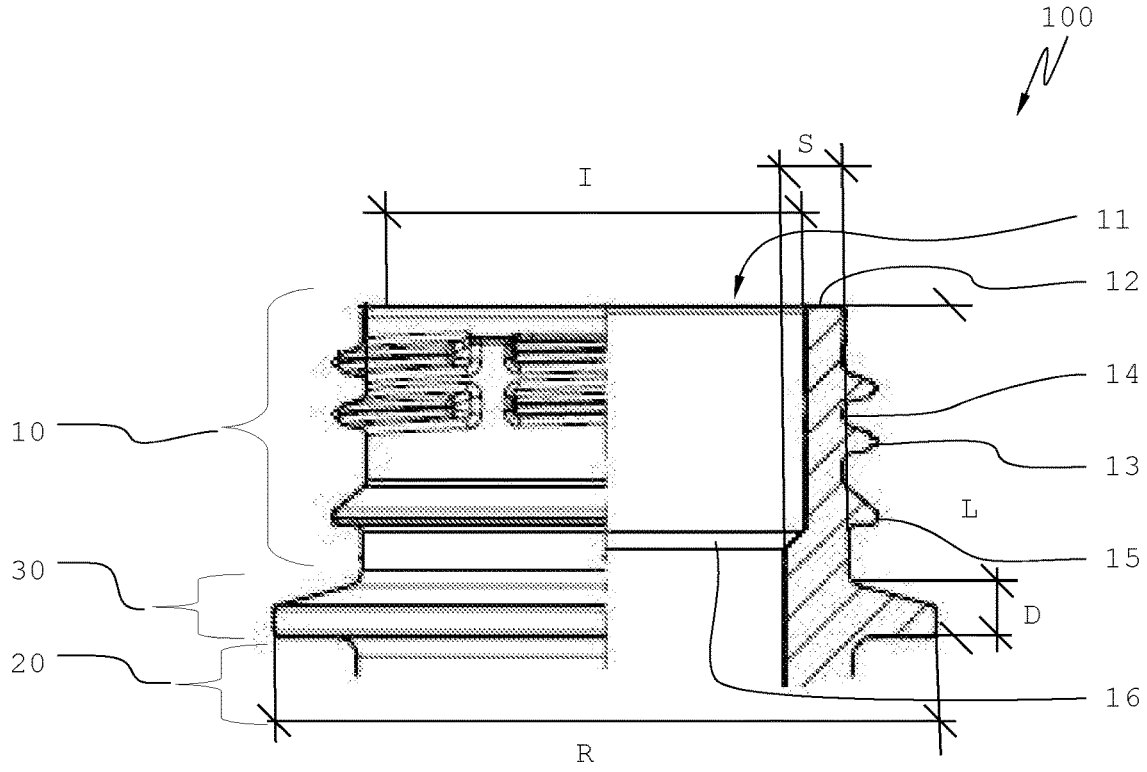

| | | | | |
|---|---|---|---|---|
| 6,283,318 | B1 * | 9/2001 | Lee | B65D 41/485 215/354 |
| 2015/0375887 | A1 * | 12/2015 | Van Dijck | B65D 1/0207 428/35.8 |
| 2017/0283115 | A1 * | 10/2017 | Hatakeyama | B05B 11/0038 |
| 2018/0186520 | A1 * | 7/2018 | Smith | B65D 41/325 |
| 2019/0135507 | A1 | 5/2019 | Schlusemann et al. | |

OTHER PUBLICATIONS

International Search Report Corresponding to PCT/EP2020/076600 mailed Dec. 22, 2020.
Written Opinion Corresponding to PCT/EP2020/076600 mailed Dec. 22, 2020.

* cited by examiner

REFILLABLE PLASTIC CONTAINER

The invention relates to a refillable plastic container—in particular, made of polyethylene terephthalate or polyethylene furanoate—according to the independent claims.

The containers, which were customary in the past, made of tinplate or non-ferrous sheet metal, of glass or also of ceramic, are increasingly being replaced by containers made of plastic. Of late, it is predominantly plastic containers that are used in particular for the packaging of fluid substances, e.g., for applications in the household, in agriculture, in industry and commerce, etc. Low weight and lower costs certainly play a not inconsiderable role in this substitution. The use of recyclable plastic materials and the overall more favorable total energy balance in their production also contribute to promoting the acceptance of plastic containers amongst users.

Plastic containers—in particular, plastic bottles—made of polyethylene terephthalate (PET) and similar materials are usually produced in a so-called stretch blow-molding process. In this case, a preform is first produced by an injection-molding process in an injection mold. Recently, even flow-molding or even extrusion blow-molding have been proposed for the production of preforms. The preform has an essentially elongate body and is formed to be closed at one longitudinal end. A gate mark originating from the injection-molding process is usually also found there. Adjoining the other end of the preform body is a neck section which is provided with a dispensing opening. The neck section already has the later shape of the container neck. In many known preforms, the preform body and the neck section are separated from one another by a so-called support ring. The support ring protrudes radially from the neck wall and serves for transporting the preform or the plastic container produced therefrom and for supporting the preform on the blow mold or for supporting the plastic container when the latter is being closed with a closure cap.

The preform is demolded after its production and can be further processed immediately while still hot in a single-stage, stretch blow-molding process. In a two-stage, stretch blow-molding process, the preform is cooled and temporarily stored for spatially—and/or temporally—separated further processing on a stretch blow-molding device. Before further processing in the stretch blow-molding device, the preform is then conditioned if necessary, i.e., a temperature profile is applied to the preform. It is then introduced into a blow mold of a stretch blow-molding device. In the blow mold, the preform is finally inflated by a gas injected at overpressure-usually air-in accordance with the mold cavity, and in this case is additionally stretched axially by means of a stretching mandrel.

An injection blow-molding method is also already known in which the stretch blow-molding process is carried out directly after the injection molding of the preform. Here, the preform remains on the injection core, which at the same time forms a kind of stretching mandrel. The preform is in turn inflated by overpressure in accordance with the mold cavity of a blow mold which is brought into position on the injection core or vice versa, and is thereby stretched by the stretching mandrel. The finished plastic container is then demolded. Stretch blow-molded or injection blow-molded plastic containers can be recognized by the gate mark usually found in the region of the container base and which originates in the preform. At this gate mark, the plastic material is only slightly or not at all stretched.

In addition to plastic containers produced from stretched preforms, there are also plastic containers which are formed by the unstretched preform itself. Examples thereof are pressure vessels for aerosols and similar filling materials. The most frequently used plastic for the plastic containers described is polyethylene terephthalate (PET). PET has been tried and tested, its chemical, physical, and mechanical properties are well-known, and it is easy to process on known installations. The recycling circuits which have been introduced and are being constantly expanded ensure that a high proportion of PET containers can be collected again after use and can be fed into renewed processing. Recently, plastic containers made of polyethylene furanoate (PEF) are also being produced, which, in particular, stand out from PET in having better barrier properties. With regard to mechanical loading capacities, plastic containers made of PET and of PEF have very similar properties.

Recently, efforts have also been made to use plastic containers several times before they are recycled. For this purpose, the collected used plastic containers must first be cleaned before they can be refilled. Since many plastic containers, e.g., containers made of PET, can soften and deform even at relatively low temperatures of, for example, 80° C., cleaning with boiling water is ruled out. Plastic containers are therefore often cleaned at lower temperatures with the aid of alkalis—for example, sodium hydroxide solution (NaOH) or potassium hydroxide solution (KOH). The use of a 1.5% to 2.5% NaOH lye at temperatures of 50° C. to 70° C. proves to be practicable.

However, the behavior of polyesters—in particular, PET and PEF—in conjunction with lyes is not without problems. Stress cracks in the plastic container can form points of attack for the lye, where, in time, degradation of the plastic can occur. In particular, a reaction between ester and lye can lead to saponification. On the plastic container, this can lead to discoloration and ultimately even to failure. The unstretched regions of plastic containers—in particular, the neck of a plastic container—are particularly susceptible to such stress-induced problems. In the case of stretch blow-molding of a PET or PEF preform, which is usually produced by an injection-molding method, the neck of the preform lies outside the blow mold and is not stretched during stretch blow-molding, and thus not stretch-solidified either. Stresses in the neck of the plastic container can lead to microscopically small cracks which can enlarge when the container is cleaned with lyes. This can lead to the neck of the plastic container developing leaks over time or no longer being able to withstand an internal pressure in the plastic container—for example, caused by carbonized beverages. The stresses in the neck of the plastic container can be of many kinds. For example, these include thermal stresses which can occur due to the different expansions of the inner wall and the outer wall of the neck of the container. During production of the plastic container from the preform, further stresses can be induced by the blowing nozzle and by the stretching mandrel with which the preform is stretched axially. Stresses in the neck can also be induced by the transport grippers or similar transport means with which the preform and the plastic containers produced therefrom are held and transported to the various system components. Finally, even axial and radial pressures from the closure cap and the torque on the neck of the container when the closure cap is fitted can lead to stresses in the neck of the plastic container.

It is therefore an aim of the present invention to remedy one or more disadvantages of plastic containers of the prior art. In particular, the prerequisites for a refillable plastic container are to be created which permit a greater number of cleanings and refillings.

This aim is achieved by the plastic container defined in the independent claim. Preferred and advantageous embodiment variants of the invention are the subject matter of the respective dependent claims.

A refillable plastic container according to the invention—in particular, a refillable plastic container made of PET or PEF—has a neck having a neck opening and a container body enclosing a filling volume which are separated from one another by an essentially radially—protruding support ring. The neck of the plastic container has an axial length, measured from an underside of the support ring up to a mouth rim bordering the neck opening, which is equal to or less than 17.25 mm. Here, the neck, at least in a section between the underside of the support ring up to the mouth rim bordering the neck opening, has a minimum wall thickness which does not fall below 1.9 mm.

In contrast to known refillable plastic containers—in particular, PET bottles—which are formed overall with relatively large wall thicknesses and a correspondingly high weight, the invention proposes optimizations of the neck of the plastic container, in order to minimize the stresses occurring during production in the unstretched region of the container. By forming the neck with a total shorter axial length as compared to known necks of disposable containers made of PET or PEF, thermal stresses resulting from different contractions of the inner wall and outer wall of the neck during production in, for example, an injection-molding process can be reduced. Due to the overall thicker-walled formation of the neck, the neck cools even more slowly and more uniformly during production, whereby the formation of stresses can be significantly reduced. Lower stresses during production of the preform lead to a significantly smaller number of microscopic cracks in the neck of the plastic container. As a result, a larger number of cycles of filling, cleaning, and refilling of the plastic containers is made possible.

For fitting a closure cap, the neck can be formed with interlocking engagement elements—in particular, threaded sections—which protrude as radial protrusions from an outer wall of the neck in a neck section which is situated between the mouth rim and the support ring.

These protrusions preferably extend over at least 85% of a circumference of the neck.

An associated closure cap can be designed, for example, as a screw cap or as a bayonet cap which has essentially complementary engagement elements. Such a closure cap is fitted by pressure and application of a torque. In order to minimize possibly resulting stresses in the neck, it is advantageous if the interlocking engagement elements extend over at least 85% of a circumference of the neck.

In order to provide the user with a visual first-opening guarantee, caps—in particular, screw caps—are provided with a tear-off guarantee strip. For this purpose, an abutment, extending circumferentially at least in sections and extending substantially radially from the outer wall of the neck, is formed on a section of the neck which is located between the support ring and an end of the interlocking engagement elements closer to the support ring. In the production of the container, a region of the neck lying between the abutment and the support ring is usually used for the engagement of transport elements, such as transport grippers. In order to thereby reduce stresses occurring in the neck, it proves expedient if this region—in particular, this region alone—has a minimum wall thickness which does not fall below 1.9.

In known necks of plastic containers, a region immediately adjacent to the mouth rim is formed as a sealing surface. A sealing cone protruding from a closure cap presses against this sealing surface when the closure cap is fitted. In order to minimize stresses thereby occurring in the neck, in a further exemplary embodiment of the invention, it proves advantageous for the neck, in a region between the interlocking engagement elements and the support ring, to have an inner wall in the form of a conical sealing surface. The sealing surface is thereby displaced axially away from the mouth rim in the direction of the interior of the plastic container and is formed in a region of the neck which is designed with a greater wall thickness. In interaction with a closure cap with a correspondingly elongated sealing cone, this leads to a reduction in the stresses in the container neck.

A further aspect of the invention therefore relates to a closure cap—in particular, a closure cap for use with a plastic container as described in the present case—which has a cover plate and, formed thereon, a substantially cylindrical barrel with interlocking engagement elements—in particular, threaded elements—which interact with correspondingly-designed, interlocking engagement elements—in particular, threaded sections—on the neck of the plastic container. Within a space enclosed by the barrel, a ring-shaped, peripheral spacer arranged concentrically to the barrel is arranged, which protrudes from the cover plate and on the free end of which a sealing lip is arranged. The spacer and the sealing lip have a maximum axial extension which is equal to or greater than the height of the cylindrical barrel. Further details and aspects of the closure cap are described below particularly in connection with the present plastic container.

In a further embodiment variant of the refillable plastic container, an inner diameter, measured at the neck opening, of the neck is less than 21.6 mm. In this case, the inner diameter in the region of the neck opening is larger than the inner diameter of the neck in the region of the support ring. This also leads to a reduction in stresses during production of the preform—in particular, in the injection-molding process.

In order to further reduce the stresses that may possibly occur, it can prove expedient for the support ring on the neck of the plastic container to have, measured over its largest radial extension, an external diameter which is equal to or less than 35 mm.

In a further embodiment variant of the invention, the design of the support ring with an axial thickness of 1.9 mm to 2.5 mm measured at the transition to an outer wall of the neck contributes to reducing the stresses.

The neck can have a wall thickness, measured at the mouth rim, of 1.4 mm to 1.8 mm.

During the blowing process, the blowing nozzle is pressed with a constant pressure against the mouth rim of the neck of the container. Since the neck has a wall thickness, measured at the mouth rim, of 1.4 mm to 1.8 mm—in particular, in conjunction with an inner diameter smaller than known necks of disposable plastic containers—the force acting on the neck can be reduced or better absorbed. In this way, stresses and microcracks in the material resulting thereby can be prevented.

In a further embodiment variant of the invention, geometric optimizations of the container neck for reducing the stresses occurring during production and assembly can also be supported by the addition of suitable additives to the plastic material. At least in the region of the neck, an addition of additives from the group consisting of terephthalic acid (PTA), isophthalic acid (IPA), monoethylene glycol (MEG), diethylene glycol (DEG), isosorbide, spiroglycol, and naphthalene dicarboxylic acid dimethyl ester (NDC) is found to be useful here.

In one embodiment of the invention, the refillable plastic container can be designed as a preform, which is produced in an injection-molding process or in a flow-molding process.

In a further embodiment of the invention, the refillable plastic container is designed as a container which is manufactured in a blow-molding process from a preform produced in an injection-molding process or in a flow-molding process. It is preferably designed as a stretch blow-molded container.

A further variant of the invention provides for a refillable plastic container, the neck of which is designed for fitting a closure cap formed in one or more parts. The closure cap can here be designed as a screw cap or as a bayonet cap. In conjunction with refillable plastic containers, caps are found to be advantageous which are made of a plastic from the group consisting of polyethylene (PE), polypropylene (PP), polyethylene terephthalate (PET), polyamide (PA), copolymers thereof, and thermoplastic elastomers (TPE). The pairing of the PET container material with the described cap materials can also contribute to reducing the occurrence of stresses in the neck of the plastic container.

A closure cap designed accordingly for use with a refillable plastic container designed according to the invention has a cover plate and, formed thereon, a substantially cylindrical barrel with interlocking engagement elements—in particular, threaded elements—which interact with correspondingly-formed, interlocking engagement elements—in particular, threaded sections—on the neck of the plastic container. Within a space enclosed by the barrel, a ring-shaped, peripheral spacer arranged concentrically to the barrel is arranged, which protrudes from the cover plate. A sealing lip is arranged on the free end of the spacer.

In a first embodiment, the spacer and the sealing lip have a maximum axial extent which is equal to or greater than a maximum distance of the interlocking engagement elements from the cover plate. The closure cap is designed for interacting with a conical sealing surface installed in the direction of the support ring into the interior of the neck of the refillable plastic container and therefore has a sealing lip arranged on a spacer. In some embodiment variants of the invention, the maximum axial extent of the spacer and the sealing lip can even be greater than an axial length of the barrel of the closure cap.

In a further embodiment, the sealing lip is designed to be circumferential and has an axial cross-section extending approximately in the shape of a trumpet. The free end of the sealing lip pointing outwards and in the direction of the cover plate of the closure cap rests on the inner wall of the neck of the plastic container in the fitted state of the closure cap. In this case, a spring-loaded elasticity of the sealing lip ensures venting when the closure cap is screwed on and a reliable sealing closure when it is fully screwed on.

In a further embodiment, the sealing lip has on its free end a circumferential, approximately olive-shaped sealing bead, which extends in the direction of an inner wall of the barrel. In the fitted state of the closure cap, the sealing bead interacts in a sealing manner with a sealing cone in a thickened region of the neck of the plastic container, said region being shifted in the direction of the support ring.

In a further embodiment, the sealing lip is designed as a sealing lip extending counter to the direction in which the spacer protrudes from the cover plate. When the closure cap is being screwed onto the plastic container, this sealing lip is thus pulled over a corresponding sealing surface arranged in the interior of the neck of the plastic container.

In a further embodiment, the closure cap can have one or more concentric sealing lips in an annular space delimited by the spacer and the barrel, said sealing lips protruding from the cover plate and resting in a sealing manner on the mouth rim bordering the neck opening in the fitted state. In this case, the additional sealing lips can rest on the mouth rim or surround it on the inner wall and on the outer wall of the neck of the plastic container.

In order to provide the consumer with a visual first-opening guarantee, in a further embodiment variant of the invention, the closure cap at the free end of the barrel can have a guarantee ring which is connected to the barrel via a number of breakable webs.

Figure 1B:
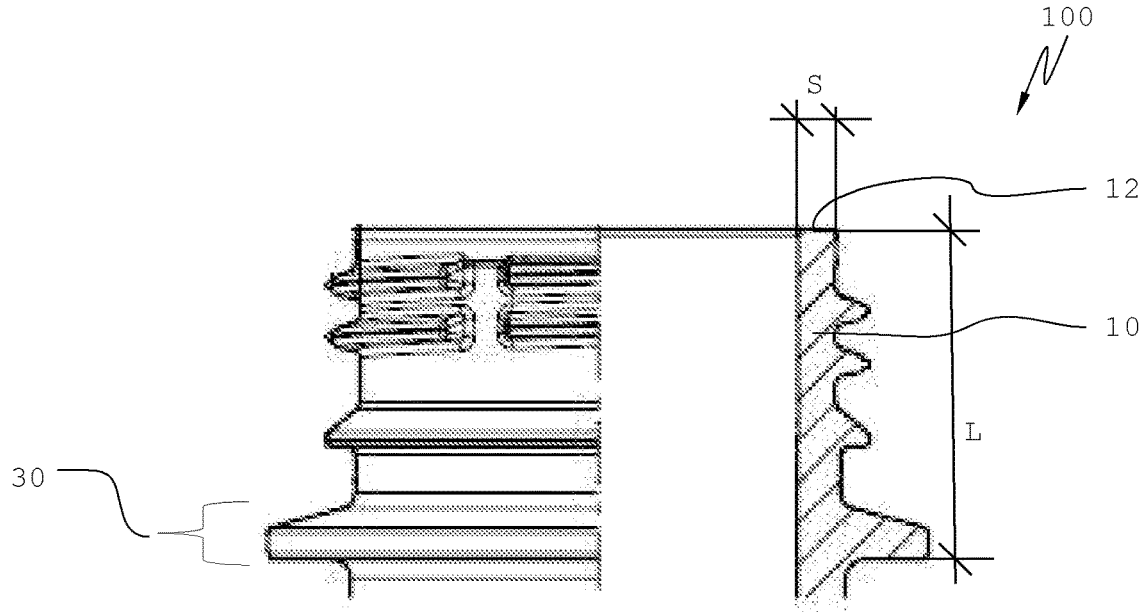
Figure 2:
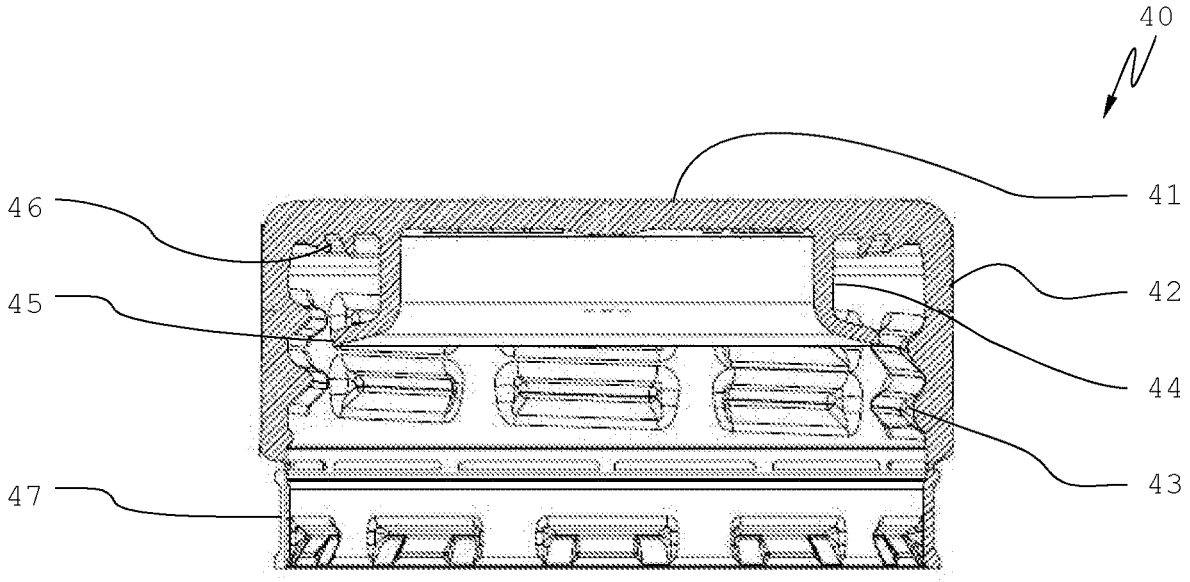
Figure 3:
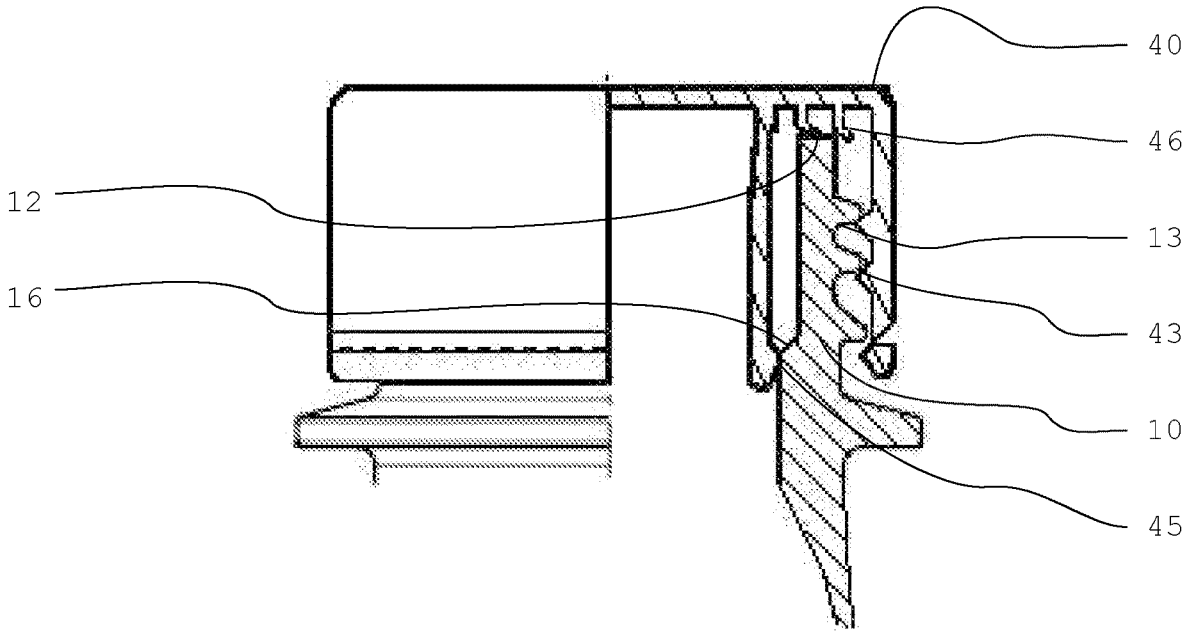

Further advantages and features become apparent from the following description with reference to the schematic drawings. Shown, in a representation not true-to-scale, are:

FIG. 1*a*: A partial axial-section representation of a neck of a plastic container according to a first embodiment;

FIG. 1*b*: A partial axial-section representation of a neck of a plastic container according to a second embodiment;

FIG. 2: A closure cap;

FIG. 3: A partial axial-section representation of the neck according to FIG. 1*a* with a screwed-on closure cap; and FIG. 4: A partial axial-section representation of the neck according to FIG. 1*b* with a screwed-on closure cap.

FIG. 1*a* shows a partial axial-section representation of a neck 10 of a plastic container 100. For the sake of greater clarity, only an upper region of the plastic container 100 is shown. Adjoining this region is a shoulder region of the container 100 and also a container body with a container bottom. The neck 10 is shown in FIG. 1. The plastic container 100 has a dispensing opening. The dispensing opening adjoins the shoulder region (not shown here) and comprises a support ring 30; arranged next thereto a neck 10 having a neck opening 11 which is bordered by a mouth rim 12. The neck 10 has an outer wall 14 on which engagement elements 13 are arranged which in the present case take the form of a thread. The thread is interrupted, but extends overall over 85% of the circumference of the neck 10. In the axial direction, i.e., in the direction towards the neck opening 11, the support ring 30 has a thickness D of up to 2.5 mm. To measure this thickness, the radii are not taken into account, but, rather, the theoretical intersections at which the surfaces meet are used as reference. In the axial direction, an axial length L between the underside of the support ring 30 and the mouth rim 12 is 17 mm. The neck 10 has a wall thickness S, which is larger in the region of the support ring 30 than in the region of the mouth rim 12. In the present case, the wall thickness S in the region of the support ring 30 is 2.5 mm and, in the region of the mouth rim 12, is 1.5 mm. Due to this difference, a conical sealing surface 16 forms inside the neck 10. The inner diameter I in the region of the mouth rim 12 is 20.6 mm. On the outer wall 14, an abutment 15 is arranged below the engagement elements 13.

FIG. 1*b* shows a partial axial-section representation of a neck 10 of a plastic container 100 in a second embodiment. This substantially corresponds to the embodiment according to FIG. 1*a*, with the difference that the wall thickness S of the neck 10 is shaped differently. In the present case, this has a constant thickness of 1.9 mm over the whole length L. The remaining elements are identical to the corresponding elements of the embodiment from FIG. 1 and are therefore not described again.

FIG. 2 shows a closure cap 40. The closure cap 40 has a cover plate 41. A barrel 42 is arranged on the cover plate 41, wherein engagement elements 43 are arranged within the barrel 42 on an inner wall. The engagement elements 43 take the form of an interrupted thread. The thread extends over 85% of the inner wall of the barrel 42. Arranged concentrically to the barrel 42 is a spacer 44, which protrudes from the cover plate 41 and extends in the direction of a guarantee ring 47. The guarantee ring 47 is arranged opposite the cover plate 41 at a lower opening of the closure cap 40. In generic use, the spacer 44 thus extends in the direction of the container. A sealing lip which extends in the direction of the barrel 42 is arranged on the spacer 44. Concentric sealing lips 46 are arranged in an annular space between the barrel 42 and the spacer 44. The concentric sealing lips 46 are designed to be in operative connection with a mouth rim 12 of a neck 10 (see FIG. 1). The sealing lip 45 is designed to be in operative connection with a sealing surface of a neck 10.

FIG. 3 shows a partial axial-section representation of the neck 10 according to FIG. 1*a*, with a screwed-on closure cap 40. In contrast to the closure cap 40 according to FIG. 2, the closure cap 40 according to FIG. 3 has a sealing bead extending radially outwards as sealing lips 45. When the closure cap 40 is being screwed onto the neck 10, the sealing bead is pressed over the conical sealing surface 16 and slides onto a sealing surface arranged below the conical sealing surface 16, which sealing surface is formed on the inner wall of the neck 10. For the screwing-on process, the engagement elements 43 of the closure cap 40 engage in engagement elements 13 of the neck 10. By rotation of the closure cap, it moves in the axial direction in the direction of the container until the concentric sealing lips 46 of the closure cap 40 rest on the mouth rim 12 of the neck 10 and thus seal the interior of the container from its surroundings.

Figure 4:
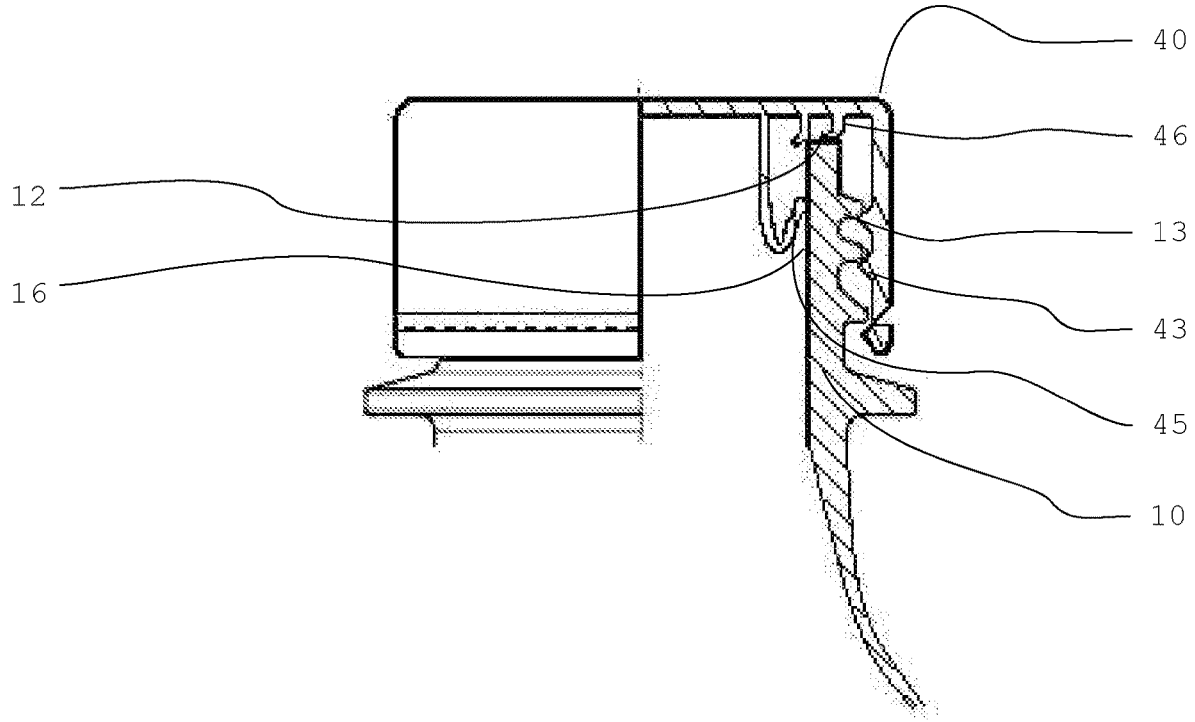

FIG. 4 shows a partial axial-section representation of the neck 10 according to FIG. 1*b*, with a screwed-on closure cap 40. The closure cap 40 is formed substantially in accordance with the closure cap 40 from FIG. 2. When the closure cap 40 is being screwed onto the neck 10, the outwardly-directed sealing lip 45 comes into contact with the mouth rim 12 and is bent over against it, and thus extends counter to the direction in which the spacer 44 (see FIG. 2) extends. When the closure cap 40 is being screwed further onto the neck 10, the sealing lips 45 bent in this way are pulled over an inner wall of the neck 10, which provides a sealing surface. The further process corresponds to that described in FIG. 3. When the closure cap 40 is being screwed on, concentric sealing lips 46 are arranged which, in an annular space between the spacer 44 and the casing 42 (see FIG. 2), come into contact with the mouth rim 12 and seal it from its surroundings.

The invention claimed is:

1. A refillable plastic bottle (100)—comprising PET or PEF—with a substantially cylindrical neck (10) having a neck opening (11) with an inner diameter of less than 21.6 mm and a container body (20) enclosing a filling volume which are separated from each other by a substantially radially-protruding support ring (30), wherein, to reduce stresses placed on the neck, the neck (10) has an axial length (L), which is equal to or less than 17.25 mm, measured from an underside of the support ring (30) up to a mouth rim (12) bordering the neck opening (11), and that the neck (10), at least in a section between the underside of the support ring (30) up to the mouth rim (12) bordering the neck opening (11), has a minimum wall thickness(S) that does not fall below 1.9 mm, such that stresses occurring during production are reduced, wherein the neck (10) is formed with interlocking engagement elements (13) which, in a neck section that lies between the mouth rim (12) and a support ring (30), protrude as radial protrusions from an outer wall (14) of the neck (10) and extend over at least 85% of a circumference of the neck (10), and wherein, on a section of the neck (10) that lies between the support ring (30) and an end of the interlocking engagement elements (13) that is closer to the support ring (30), an abutment (15) is formed that extends circumferentially at least in regions and protrudes substantially radially from the outer wall of the neck, wherein in an axial direction from the abutment to the support ring, and over a length from the abutment to the support ring, the neck has a thickness, and the thickness either increases from the minimum wall thickness of the neck to a greatest wall thickness of the neck or is equal to the greatest wall thickness.

2. The refillable plastic bottle (100) according to claim 1, wherein the inner diameter of the neck opening (11) is greater than the inner diameter of the neck (10) in the region of the support ring (30).

3. The refillable plastic bottle (100) according to claim 1, wherein the support ring (30) has, measured over its largest radial extension, an outer diameter (R) which is equal to or less than 35 mm.

4. The refillable plastic bottle (100) according to claim 1, wherein the support ring (30) has an axial thickness, measured at the transition to an outer wall (14) of the neck, of 1.9 mm to 2.5 mm.

5. The refillable plastic bottle (100) according to claim 1, wherein the neck (10) has a wall thickness, measured at the mouth rim (12), which is 1.4 mm to 1.8 mm.

6. The refillable plastic bottle (100) according to claim 1, wherein, axially, from the support ring (30) up to the mouth rim (12), the neck (10) has a uniformly thick wall thickness.

7. The refillable plastic bottle (100) according to claim 6, wherein the closure cap (40) has a cover plate (41) and, formed thereon, a substantially cylindrical barrel (42) with interlocking engagement elements (43) which interact with correspondingly-formed, interlocking engagement elements (13) on the neck (10) of the plastic bottle (100), wherein, within a space enclosed by the barrel (42), a ring-shaped spacer (44) arranged concentrically to the barrel (42) is arranged, which protrudes from the cover plate (41) and on whose free end a sealing lip (45) is arranged.

8. The refillable plastic bottle (100) according to claim 7, wherein the sealing lip (45) is formed circumferentially and has an axial cross-section extending approximately in the shape of a trumpet.

9. The refillable plastic bottle according to claim 8, wherein, on its free end, the sealing lip (45) has a peripheral sealing bead.

10. The refillable plastic bottle according to claim 9, wherein the peripheral sealing bead is designed in the shape of an olive and extends in the direction of the barrel (42).

11. The refillable plastic bottle (100) according to claim 7, wherein, in the assembled state, the sealing lip (45) rests in a sealed manner against a sealing cone (16) formed in the neck (10).

12. The refillable plastic bottle (100) according to claim 7, wherein, in an annular space delimited by the spacer (44) and the barrel (42), one or more concentric sealing lips (46) are arranged which protrude from the cover plate (41) and, in the assembled state, rest in a sealed manner against the mouth rim (12) bordering the neck opening (11).

13. The refillable plastic bottle (100) according to claim 7, wherein a free end of the barrel (42) is connected to a guarantee ring (47) by a number of breakable webs.

14. The refillable plastic bottle (100) according to claim 7, wherein the interlocking engagement elements (43) are threaded elements which interact with correspondingly-formed, thread sections on the neck (10) of the plastic bottle (100).

15. The refillable plastic bottle (100) according to claim 1, wherein the plastic material is a polymer which contains, at least in the region of the neck, fractions from the group consisting of terephthalic acid (PTA), isophthalic acid (IPA), monoethylene glycol (MEG), diethylene glycol (DEG), isosorbide, spiroglycol, and naphthalene dicarboxylic acid dimethyl ester (NDC).

16. The refillable plastic bottle (100) according to claim 1, wherein it is formed as a plastic bottle (100) manufactured in a blow-molding process from a preform produced in an injection-molding process or in a flow-molding process.

17. The refillable plastic bottle according to claim 16, wherein it is formed as a stretch blow-molded plastic bottle (100).

18. The refillable plastic bottle (100) according to claim 1, wherein the neck (10) is designed for the fitting of a closure cap (40) formed in one or more parts.

19. The refillable plastic bottle (100) according to claim 18, wherein the closure cap (40) is designed as a screw cap or as a bayonet cap.

20. The refillable plastic bottle (100) according to claim 18, wherein the closure cap (40) is made of a plastic from the group consisting of polyethylene (PE), polypropylene (PP), polyethylene terephthalate (PET), polyamide (PA), copolymers thereof, and thermoplastic elastomers (TPE).

21. The refillable plastic bottle (100) according to claim 1, wherein the closure cap (40) has a cover plate (41) and, formed thereon, a substantially cylindrical barrel (42) with interlocking engagement elements (43) which interact with correspondingly-formed, interlocking engagement elements (13) on the neck (10) of the plastic bottle (100), wherein, within a space enclosed by the barrel (42), a ring-shaped spacer (44) arranged concentrically to the barrel (42) is arranged, which protrudes from the cover plate (41) and on whose free end a sealing lip (45) is arranged, wherein the spacer (44) and the sealing lip (45) have a maximum axial extension which is equal to or greater than the height of the cylindrical barrel (42).

22. The refillable plastic bottle (100) according to claim 21, wherein the interlocking engagement elements (43) are threaded elements which interact with correspondingly-formed thread sections on the neck (10) of the plastic bottle (100).

23. The refillable plastic bottle of claim 1 wherein a region of the neck (10) lying between the abutment (15) and the support ring (30) does not fall below the minimum wall thickness of 1.9 mm.

24. The refillable plastic bottle (100) according to claim 1, wherein the interlocking engagement elements (13) are thread sections.

25. The refillable plastic bottle of claim 1 wherein the mouth rim (12) includes an upper surface, the upper surface being planar across the width of the mouth rim.

26. The refillable plastic bottle of claim 1 comprising an abutment (15) between the support ring (30) and the end of the interlocking engagement elements (13) that is closest to the support ring, wherein in an axial direction from the abutment to the support ring, the minimum wall thickness of the neck either increases to a greatest wall thickness or is equal to the greatest wall thickness.

27. A refillable plastic bottle (100)—comprising PET or PEF—with a substantially cylindrical neck (10) having a neck opening (11) and a container body (20) enclosing a filling volume which are separated from each other by a support ring (30) which radially protrudes from an outer wall (14) of the neck (10), wherein, to reduce stresses placed on the neck, the neck (10) has an axial length (L), which is equal to or less than 17.25 mm, measured axially from an underside of the support ring (30) up to a mouth rim (12) bordering the neck opening (11), and that the neck (10), at least in a section between the underside of the support ring (30) up to the mouth rim (12) bordering the neck opening (11), has a greatest wall thickness(S) that is equal to or greater than 1.9 mm, the neck (10) has interlocking engagement elements (13) and an abutment (15) which extend circumferentially at least in regions around a circumference of the neck (10) and radially protrude from the outer wall (14), wherein the interlocking engagement elements (13) are axially arranged adjacent the mouth rim (12) and the abutment (15) is axially arranged between the interlocking engagement elements (13) and the support ring (30), wherein, in a region axially between the abutment (15) and the support ring (30), the neck (10) has an inner wall formed as a conical sealing surface (16).

* * * * *